United States Patent [19]

Adomitis et al.

[11] 4,182,383

[45] Jan. 8, 1980

[54] FLUIDIZED BED POWDER DISCHARGE AND METERING METHOD AND APPARATUS

[75] Inventors: John T. Adomitis; Richard I. Larson, both of Wilmington, N.C.

[73] Assignee: General Electric Company, San Jose, Calif.

[21] Appl. No.: 918,224

[22] Filed: Jun. 23, 1978

[51] Int. Cl.[2] ..... B65B 1/32

[52] U.S. Cl. ..... 141/5; 137/625.21; 141/83; 141/102; 177/122; 222/195; 406/128

[58] Field of Search ..... 141/1, 4–6, 141/11, 39, 44, 47, 49, 52, 67, 83, 100, 102, 192, 279, 284, 285, 382, 301; 177/1, 16, 50, 121, 122, 123; 53/473, 502; 214/17 B; 222/556, 195, 37, 38, 1; 302/3, 41, 42, 49, 52, 59; 137/625.21–625.24

[56] References Cited

U.S. PATENT DOCUMENTS

| | | | |
|---|---|---|---|
| 3,128,129 | 4/1964 | Stine et al. | 302/35 |
| 3,163,329 | 12/1964 | Mornas | 222/1 |
| 3,237,805 | 3/1966 | Stogner | 222/1 |
| 3,319,828 | 5/1967 | Maxwell | 222/1 |
| 3,355,221 | 11/1967 | Reuter | 302/53 |
| 3,474,874 | 10/1969 | Pettis, Jr. | 177/50 |
| 3,599,832 | 8/1971 | Smith | 222/1 |
| 3,632,173 | 1/1972 | Reuter | 302/3 |
| 3,773,221 | 11/1973 | Lesk et al. | 222/56 |
| 3,776,599 | 12/1973 | Reuter | 302/3 |
| 3,837,540 | 9/1974 | Wagener | 222/193 |
| 3,840,155 | 10/1974 | Frye et al. | 222/195 |
| 3,887,110 | 6/1975 | Porter | 141/102 X |
| 3,942,562 | 3/1976 | Ridgway et al. | 141/83 |

*Primary Examiner*—Frederick R. Schmidt
*Attorney, Agent, or Firm*—Samuel E. Turner; Joseph B. Forman; Fred Jacob

[57] ABSTRACT

A metering method and apparatus is provided for the controlled discharge of powder from a fluidized-bed blender to a material container, which gives accurate material weights while separating powder from fluidizing gas. In this method the material container is filled with a series of short duration discharges at a reduced powder flow rate. This method enables the apparatus to more precisely measure the weight of the container and maintain homogeneity of the blended material in both the bed and the container. The apparatus for carrying out this method includes a flexible pressure-tight sleeve connecting the fluidized bed to the container. When a ball valve located at the bottom of the fluidized bed opens to discharge powder, the sleeve retains the high pressure fluidizing gas inside the sleeve and the container. This causes the pressure to build at the outlet of the valve thus preventing the gas from rapidly exhausting and forcing powder through the outlet. The short duration discharges are terminated when a load cell, provided to electronically weigh the container, measures a predetermined material weight. To improve accuracy, the load cell measurement is monitored only during the relatively quiescent period between discharges, and the measured weight of the material in the container is continuously corrected to eliminate the effects of fluidizing gas pressure forces. Finally, an off-gas hose extending from the container lid exhausts the fluidizing gas at a controlled rate of flow and separates the gas from the powder.

13 Claims, 7 Drawing Figures

FIG. 4
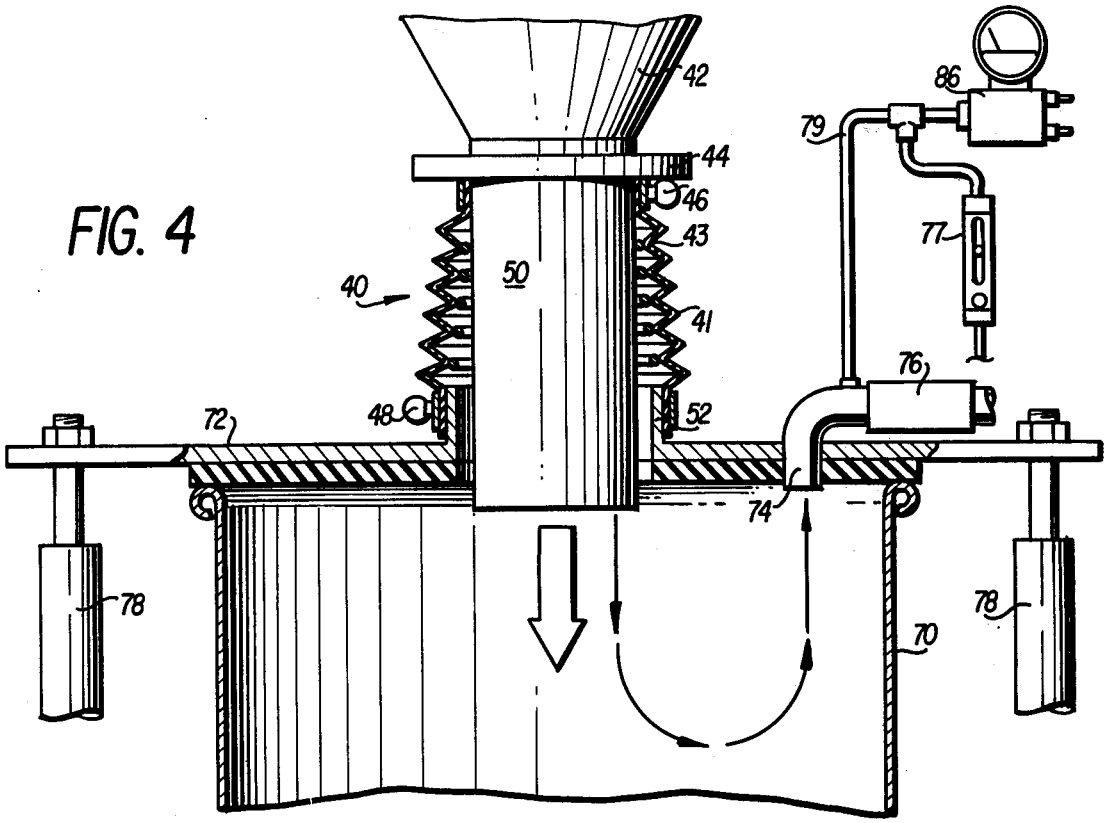
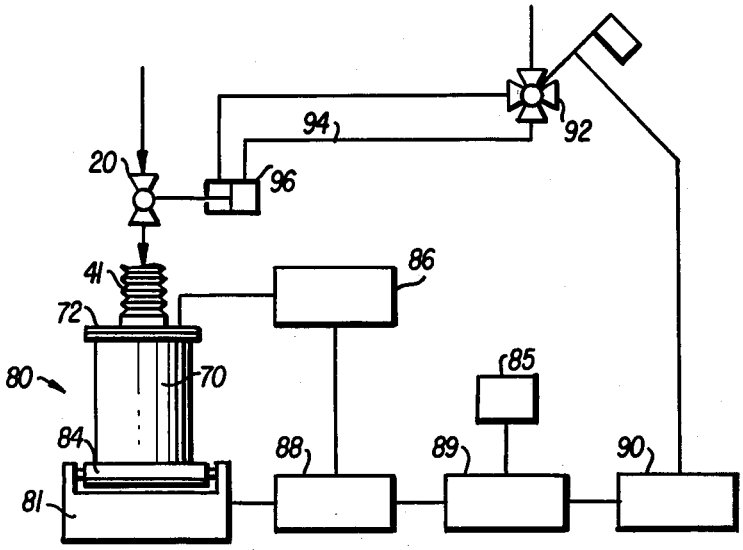
FIG. 5

FLUIDIZED BED POWDER DISCHARGE AND METERING METHOD AND APPARATUS

BACKGROUND OF THE INVENTION

1. Field of the Invention

This invention relates to metering devices for discharging predetermined amounts of powder from a fluidized bed into containers.

2. Description of the Prior Art

Homogeneity and enrichment blending of $UO_2$ powder is a major process step in the manufacturing of $UO_2$ pellets. The fluidized bed blender produces almost ideal blends by incorporating the mixing action of gas bubbles to produce a homogeneous powder mixture. However, fluidization of a powder bed is characterized by the entire weight of the powder being suspended by the flow of gas rising through the bed. When fluidized powder is discharged from the bottom of such a fluidized bed blender, the gas and powder have an extremely high flow rate because of a gravitational pressure head created by the mass of fluidized material above the powder discharge outlet. A rapid flow rate of fluidizing gas from this outlet tends to destroy the homogeneous mixture by collapsing the fluidization state of the powder. Also, a rapid flow rate of material from the outlet makes it difficult to accurately meter fluidized material into containers.

It is generally necessary to limit the container weights of $UO_2$ powder to a maximum of 35 kilograms to comply with nuclear safety and OSHA requirements. Testing has shown that the flow rates encountered in an unrestricted discharge from the bottom of a 500 kilogram fluidized bed can be as high as 5 kilograms per second through a typical 1.5 inch ball valve. It is difficult to meter 30 to 35 kilograms of powder into containers at this flow rate with any reasonable degree of accuracy, due to inertia forces of powder on the container and response time of valve closings.

In addition, it has been demonstrated that the flow of gas and powder through a ball valve during the discharge sequence produces pressure force fluctuations on the container, which are difficult to correct for when making container weight measurements. If these fluctuations are not compensated for, an apparent downward force is produced by the fluidizing gas. The downward force is a result of the gas pressure acting on the apparatus and container construction. A circular cross-section is removed from the middle of the container lid to serve as the inlet for the powder with the result that the surface area of the remainder of the lid is less than the surface area of the container bottom. Since the gas exerts an equal pressure on all areas of the container interior this differential in surface area results in an apparent downward force on the container. When the weight of the container and the powder contained therein is measured, this apparent downward force must be corrected for, or the measured weight of the container will be inaccurate.

The fluidizing action also causes the powder to become entrained in the fluidizing gas creating two additional problems. First, the powder which is suspended in the fluidizing gas must be separated and deposited in the bottom of the container. Second, the containers must exhaust a controlled amount of fluidizing gas and any residual powder in the form of dust suspended in the gas. This must be accomplished without significantly reducing the pressure in the container and without exhausting large amounts of powder and gas from which the powder must be extracted by filtering equipment to insure that the gas ultimately discharged into the atmosphere meets the very strict standards applied to the nuclear manufacturing establishments.

It is therefore an object of this invention to provide an improved powder discharge and metering method and apparatus for a fluidized bed blender which accurately meters the discharge of predetermined amounts of powder into containers while maintaining the homogeneity of the blended material.

Another object of this invention is to provide a fluidized bed powder discharge and metering method and apparatus which is substantially enclosed so as to lower the pressure drop across the discharge outlet and decrease the rate of gas outlet flow, so as to maintain the homogeneity of the blended material by maintaining fluidization.

Another object of this invention is to provide a fluidized bed powder discharge and metering method and apparatus which is substantially enclosed so as to lower the pressure drop across the discharge outlet and decrease the rate of gas outlet flow, permitting more accurate metering of the powder in discharge.

It is another object of this invention to correctly weigh the container, to minimize the effects of gas pressure fluctuation on the measured container weight and to terminate powder discharge when the container has been loaded with a predetermined weight of powder.

It is another object of this invention to provide a method and apparatus in which the powder is metered in short duration discharge periods, the powder deposited in the container is weighed during the intermittent, relatively quiescent periods between the powder discharges, and the discharge periods are terminated when the container has been loaded with a predetermined weight of powder.

It is another object of this invention to provide a fluidized bed powder discharge and metering apparatus which creates a substantially enclosed system during powder discharge and exhausts the excess fluidizing gas from the container while minimizing the amount of powder exhausted and released into the atmosphere.

SUMMARY OF THE INVENTION

A fluidized bed powder discharge and metering method and apparatus is provided which is suitable for discharging predetermined weights of powder from a fluidized bed into pail-type containers. The purpose of the fluidized bed is to blend different types of powder to achieve a homogeneous powder mixture. While fluidizing gas promotes the blending action it also supports the entire weight of the powder in the fluidized bed. This mass of fluidized powder creates a gravitational pressure head over the bottom of the fluidized bed. The pressure head causes rapid pressure-induced powder outflow making it difficult to accurately meter and measure the powder that is being discharged from the fluidized bed into the container.

This invention minimizes pressure-induced powder outflow by substantially enclosing and pressurizing the entire system from the fluidized bed to the interior of the container. This decreases the pressure drop across a ball valve outlet from the fluidized bed, thereby reducing the powder outflow during discharge. To create the enclosed system, the ball valve outlet is connected to a pressure-tight lid on the container by a hopper and a flexible sleeve thus forming one continuous pressurized vessel. The sleeve must be flexible so it can linearly deflect in a vertical direction while the container is being loaded, thereby mechanically isolating the structural forces on the upper part of the sleeve from the container positioned on the weighing apparatus. The sleeve must be capable of deflecting upwardly an even greater distance when the lid is lifted off the container. While the sleeve is flexible it is also structurally reinforced to prevent the sleeve from distorting due to gas pressure forces. Distortion of the sleeve can cause angular misalignment of the sleeve which will exert vertical force components that can add to or subtract from the measured weight of the container.

The container lid to which the sleeve is attached is provided with an off-gas hose sufficiently small in diameter to restrict the free flow of gas thereby controlling the container pressure. While it is controlling the container pressure, the off-gas hose must exhaust a controlled flow of gas and a minimum of powder material. To accomplish this the off-gas hose is positioned on the lid so as to force the expanding fluidizing gas flowing into the container to make a 180 degree change in direction to enter the hose. The powder carried by the gas has a greater mass and continues to fall while the gas changes direction to flow up. This effectively separates substantially all of the powder from the gas. The remaining powder in the gas is pneumatically transferred to an off-gas system as a consequence of the small size of the off-gas hose.

The sequence of operations begins when the fluidizing gas is injected into the bed to begin mixing the powder. When a homogeneous mixture is achieved, the discharge of powder is commenced by rotating the ball of the ball valve to open the valve and allow discharge of powder from the fluidized bed into the container. Between the dishcarge periods, when the ball valve is closed, the homogeneity of the blended material remaining in the fluidized bed is preserved by the injection of the blending gas through the closed ball valve. The gas flow is stopped during each of the discharge openings to allow the free flow of fluidized material through the valve. When the ball valve is opened, it is controlled to open in short periods of a predetermined duration. The duration of each discharge period is varied by a controller in inverse proportion to the amount of material remaining in the fluidized bed. This results in metering nearly equal aounts of powder in each discharge period. Approximately 10 discharges are required to fill one container with the desired weight of 31.5 kilograms of powder.

A load cell, mounted below the container, electronically measures the container weight throughout the discharge sequence. However, the controller monitors the load cell measurement only during the relatively quiescent time span between discharge periods while the valve is closed. This prevents the extremely large and rapid pressure fluctuations which occur each time the ball valve opens and closes from affecting material weight measurements. Also, the time of monitoring is delayed by a specific period after each ball valve closing to allow the powder to settle and the pressure fluctuations to diminish.

Additionally, an electric compensating circuit is provided which eliminates the weight measurement error that would otherwise result from the effect of the fluidizing gas pressure on the different surface areas of the top and bottom of the container. The electric compensating circuit produces an electrical signal corresponding to the actual material weight. When the controller determines that the total weight of powder has been deposited in the container, the ball valve opening and closing sequence is terminated.

During the time span after filling a container and until just before the start of filling the next container, the homogeneity of the blended material remaining in the fluidized bed is preserved by suddenly terminating the flow of the fluidizing gas into the fluidized bed and removing the fluidizing gas already in the bed. This essentially "freezes" the particles in place relative to each other, reducing the amount of gas used and reducing the amount of material carried over into the off-gas system.

In an alternate embodiment of this invention, the fluidizing gas is discharged into an aperture in the ball valve at a right angle to the material flow when the ball valve is open. The gas flow through the valve creates a pinching effect which also works to effectively slow the material outflow. This pinching effect would be employed to counteract the rapid pressure-induced outflow occurring when the fluidizing bed contains a large mass of powder.

In another alternate embodiment a controlled restriction, such as a pinch valve, is placed in the off-gas hose. This restruction is operated so as to raise the gas pressure in the discharge and metering apparatus, thereby reducing the flow rate of material when required.

BRIEF DESCRIPTION OF THE DRAWINGS

While the specification concludes with the claims particularly pointing out and distinctly claiming the subject matter of the invention, it is believed the invention will be better understood from the following description taken in conjunction with the accompanying drawings, wherein:

FIG. 4 is an enlarged sectional view showing a conduit assembly, container and container lid employed in the apparatus of this invention;

FIG. 5 is a block diagram illustrating schematically a container weight measuring system employed in the apparatus of this invention;

For greater ease of understanding the invention, a summary description of the apparatus will be first set forth. Thereafter, a detailed description of the individual components of the apparatus will be given, followed by a detailed description of the method of operation.

SUMMARY DESCRIPTION OF THE APPARATUS

Figure 1:
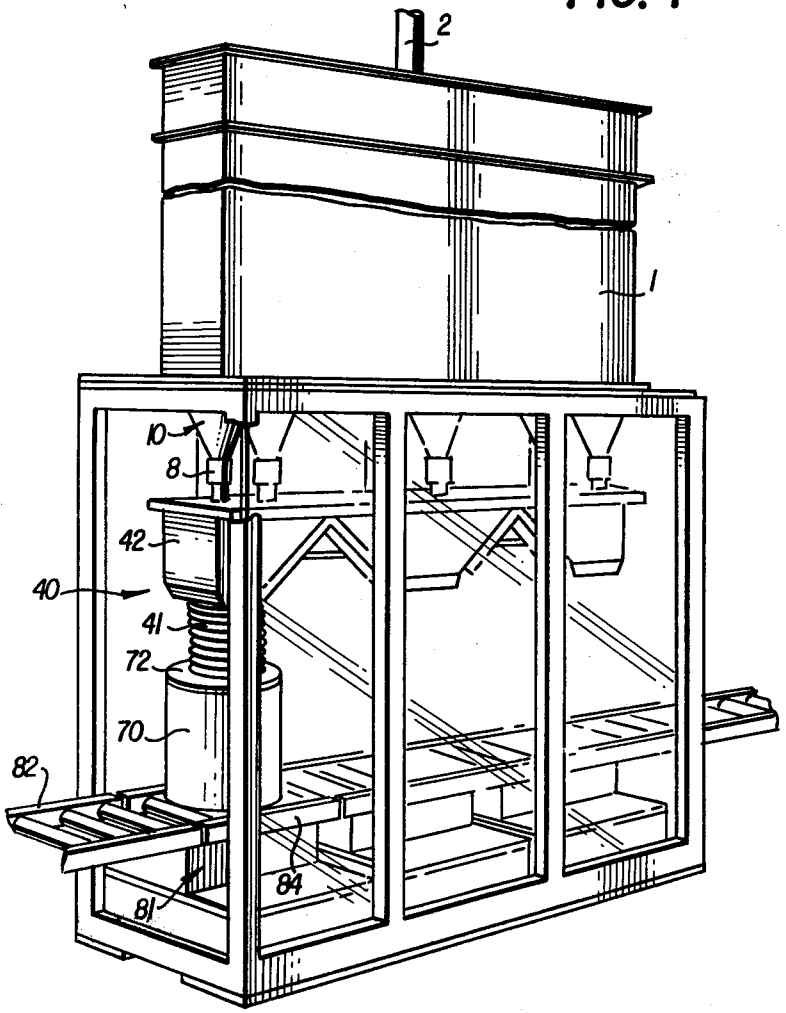
FIG. 1 is a perspective view showing the fluidized bed powder discharge and metering apparatus of this invention.

Referring first to FIG. 1, it can be seen that the fluidized bed powder discharge and metering apparatus includes four major sections there illustrated, namely, a fluidizing bed or vessel 1, a valved outlet 10 from the fluidizing bed, a container 70 and a conduit assembly 40 connecting the valve to the container. The apparatus further includes a fifth major section, namely, a container weight measuring system 80 which is shown in block diagram form in FIG. 5.

Figure 2:
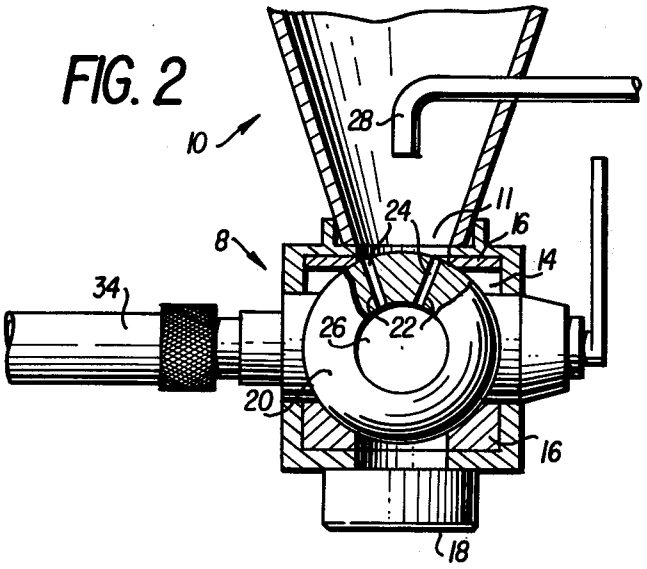
FIG. 2 is an enlarged view, partly in section and partly broken away, showing a closed ball valve outlet from a fluidizing bed employed in the apparatus of this invention.
Figure 3:
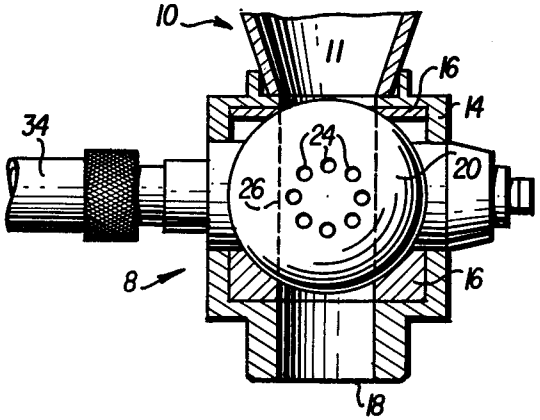
FIG. 3 is an enlarged view, partly in section and partly broken away, showing the ball valve outlet in FIG. 2 after the ball has been rotated 90° to an open position.

The operations begin in the region of the fluidizing bed 1 shown in FIG. 1 and the valved outlet 10 shown in FIGS. 1, 2 and 3. A plurality of outlets and valves are provided to empty powder from the fluidized bed into a plurality of containers. While a plurality of valves and containers are employed in the specific embodiment of this invention disclosed in this application, the apparatus could also be constructed and operated with a single valved outlet into a single container. For simplicity of description, only a single valved outlet and a single container are described, but it will be understood that the other outlets and containers are of identical construction.

A valved fill chute 2 (shown in FIG. 1) is mounted on top of the fluidized bed to provide an inlet for $UO_2$ fuel powders. The powder is introduced into the bed and blended by the fluidizing gas into a homogeneous mixture.

To initiate the blending operations, fluidizing gas is injected into the fluidizing bed from two sources. The first source is a nozzle 28 shown in FIG. 2 which extends into the upper portion of the valved outlet 10. The second source of fluidizing gas is from the interior of a valve 8 positioned at the lower end of the valved outlet 10. The gases are injected from orifices 24 in the central cavity of the valve. The details of the construction of this valve are disclosed and claimed in the copending patent application of Larson et al., Ser. No. 803,727, filed Apr. 27, 1977, entitled "Method and Apparatus for Blending Fine and Cohesive $UO_2$ Powders In a Fluidizing Bed With Gas Injection Through Ball Valves".

A controller 90, shown in FIG. 5, is provided for controlling the opening and closing of the valve. To initiate the actual discharge of powder from the fluidized bed, after a homogeneous powder mixture has been achieved the controller produces an electrical signal to open the valve, and the discharge of fluidized powder begins. The controller is programmed to cause the valve to be open for only a brief period of time and then to cause the valve to again be closed. With this method of operation, the powder is discharged in short duration discharge periods. Several successive valve openings causing several successive discharge periods are required to fill each container.

An apparatus is provided to monitor the container weight for the purpose of loading each container with a predetermined weight of powder. This apparatus includes the controller 90 which continues the opening and closing of the valve 8, causing short duration discharges until the container is loaded with the predetermined weight of powder. During discharging, a load cell 81 produces an electrical signal representative in strength of the weight of the container and the powder deposited therein. A comparator 89 receives the load cell signal after the signal has been adjusted to compensate for fluidizing gas pressure forces on the container. The received signal is compared to a reference signal transmitted from a set point apparatus 85 corresponding to the desired weight of powder to be loaded into a container, and when the reference signal is equaled, the comparator signals the controller to discontinue opening the valve.

A discharge from the valve empties into a pressurized hopper 42 shown in FIGS. 1 and 4. The hopper is provided for directing the flow from multiple valve outlets into a single container. An outlet tube 50 is provided to direct the powder flow from the hopper into the container.

The apparatus which serves to create a substantially enclosed pressurized system to lower the pressure drop across the valve, and prevent the fluidizing gas pressure in the bed from forcing powder through the valve at high flow rates, is shown in FIGS. 1 and 4. The substantially enclosed system includes the vessel, valved outlet, conduit assembly and the container. The conduit assembly 40 is provided to form a pressure-tight path for the powder to flow through from the valve into the container. This prevents the fluidizing gas from escaping so that it is retained in the conduit assembly and the container after the gas has been discharged from the open valve. Retention of the gas causes the pressure to build in the region beyond the valve exit thus lowering the pressure differential across the valve. Therefore, the conduit assembly is an essential element in creating a substantially enclosed system for the purpose of lowering the powder flow rate.

The container is covered with a container lid 72 which, in turn, is provided with an off-gas hose 74 to exhaust gas from the container. The off-gas hose is positioned on the container lid such that material entering the container through the conduit assembly 40 must make a 180 degree change in direction in order to enter the off-gas hose. Since the powder has a greater mass and inertia than the gas, the powder tends to continue to flow down while the gas changes direction to flow up and exit the container. This separates substantially all of the powder from the gas leaving the powder to collect in the bottom of the container.

After a container is filled with a predetermined weight of powder, the filled container is removed and replaced by an empty container. The discharge sequence is resumed, and the process is continuously repeated until all of the powder originally introduced into the bed has been discharged into containers.

DETAILED DESCRIPTION OF THE INDIVIDUAL COMPONENTS

Individual components of the fluidized bed powder discharge and metering apparatus summarized briefly above, will now be discussed in greater detail.

Referring to FIG. 1, the fluidizing bed 1 of this apparatus is a vessel in which a variety of different types and sizes of particulate matter or powder are blended together into a homogeneous mixture. The fluidizing bed structure itself is not part of the subject invention, and any suitable type may be employed. Therefore, this portion of the apparatus is not described in detail. One suitable form of fluidizing bed is disclosed in the previously mentioned copending patent application of Larson et al., Ser. No. 803,727.

The fluidizing bed is provided with a valved fill chute 2 through which the various powders are introduced. In the present embodiment, the bed is initially filled with approximately 500 kilograms of powder. After a sufficient amount of powder has been introduced the fill chute valve is closed. Below the fill chute the fluidizing bed is a vertically oriented, slab-shaped, nuclear-safe, mixing vessel having a plurality of fluidizing gas outlets disposed at the bottom of the vessel. The structures which provide fluidizing gas include a linear array of valved outlets 10 each having walls converting into a conical-shaped opening 11, and each outlet contains a nozzle 28 (shown in FIG. 2) for the purpose of injecting fluidized gas into the fluidizing bed.

A plurality of valved outlets are necessary in a large fluidizing bed such as the bed in the current embodiment, in order to maintain a fluidized state and homogeneous mixture of the powder during discharge. However, if the fluidizing bed is substantially reduced in size, this invention will operate in a satisfactory manner if the bottom of the fluidized bed comprises a single valved outlet emptying into a single container. For ease of understanding, the apparatus will be described in terms of the fluidizing bed emptying into a single container. It will be understood that the structure of emptying into each of the other containers, where multiple containers are employed, is essentially the same as that described herein for one container.

The fluidizing bed blends powder particles by the action of bubbles of fluidizing gas rising from the bottom of the fluidizing bed. The gas interacts with the particles to eventually bring the powder mass in the bed to a fluidized state, in which the powder is suspended by fluidizing gas. Once the powders are sufficiently mixed to achieve a homogeneous mixture, the powder is ready for discharge from the bed through the valved outlets 10.

As shown in FIGS. 1, 2 and 3, the valves 8 are mounted in the lower region of the valved outlets 10. The valve employed in this embodiment is a 1.5 inch diameter ball valve. The size of the ball valve has been experimentally determined to be the minimum diameter required to prevent $UO_2$ powder from bridging and blocking powder flow when the last portion of the $UO_2$ powder in the fluidized bed is discharged. Since smaller ball valves are subject to this problem of the powder bridging and blocking flow, they cannot be employed in a fluidized bed discharge apparatus to lower $UO_2$ powder flow rates.

The valve employed in the embodiment comprises a ball valve body 14 and an internally mounted rotating ball 20. The ball is held in position by seals 16 which maintain sealing contact with the ball while still permitting the ball to rotate. The structure of the ball 20 includes a large aperture 26 extending completely through the interior of the ball. Additionally, smaller diameter apertures 22 extend from the large aperture to the surface of the ball at various angles to the large aperture. The smaller apertures extend to the plurality of orifices 24 arranged in a circle about the surface of the ball.

The smaller apertures 22, the orifices 24 and the large aperture 26 accomplish several functions in the operation of the ball valve. First, when the ball 20 is oriented in a closed position as it is shown in FIG. 2, the large aperture extends horizontally and the discharge of powder from the fluidizing bed is blocked. However, exactly the reverse is true of the smaller apertures 22. Therefore, in this position of the valve, gas is injected from line 34 into the valve body 14, into the large aperture 26, through the smaller apertures 22, and out the orifices 24 into the fluidizing bed. In this way fluidizing gas is introduced into the fluidizing bed to maintain blending conditions. The apparatus to accomplish this function before the discharge sequence begins is both described and claimed in the previously mentioned copending patent application of Larson et al., Ser. No. 803,727. The copending Larson et al. patent application does not, however, describe or claim the method of injecting the fluidizing gas from the ball valve during the discharge sequence between discharge periods.

The large aperture 26 of the valve also functions to discharge powder from the fluidizing bed. The valve construction allows rotation of the ball from the position shown in FIG. 2 through a 90 degree angle to the position shown in FIG. 3 so as to bring the large aperture into a vertical position in communication with both the opening 11 and an exit region 18 from the ball valve. In this open position, the large aperture provides for discharge of powder from the fluidizing bed. Additionally, while the ball is in this position, the smaller apertures 22 now provide communication for the continued flow of fluidizing gas from the gas injection line 34 to the interior of the ball valve body 14, through the orifices 24, the apertures 22 and inwardly to the large aperture 26. Since the gas enters the large aperture at a right angle to the material flow, it restricts the flow path of the powder through the aperture 26, and thus further reduces the amount of powder flowing therethrough in a given period of time. This further contributes to the accurate control of the amount of powder supplied to the container.

Referring back to FIG. 1, the conduit assembly 40 provides a pressure-tight passageway for the powder to flow through. The elements of the conduit assembly include the hopper 42 which is positioned below the valve and serves to consolidate the powder flow from multiple valves for direction into a single container. The remainder of the conduit assembly 40, shown in FIG. 4, comprises a flexible sleeve 41, the outlet tube 50 and a larger diameter upwardly extending inlet 52, all of which are provided to direct the powder flow from the hopper into the container. The flexible sleeve 41 is reinforced with metal rings 43 to prevent the sleeve from distorting due to pressure forces during valve openings. Distortion of the sleeve would create physical forces on the container which would affect container weight measurements. A hopper flange 44 is positioned at the bottom of the hopper. The flange serves to locate the upper edge of the flexible sleeve 41 which is attached with a clamp 46 to the outlet tube 50 directly below and abutting the hopper flange. The lower edge of the flexible sleeve is attached to the upwardly extending inlet 52 with a second clamp 48.

The container 70 in this embodiment is a round five-gallon pail with an open top. The container rolls on a conveyor under a lid 72 which is then clamped down by pneumatic cylinders 78. The upwardly extending inlet 52 extends from the center of the lid. The off-gas hose 74 also extends from the lid and is provided for pressure control of the container. In an alternate embodiment an adjustable valve 76 is mounted in the off-gas hose to control the exhaust of gas from the container. The off-gas hose is positioned such that material entering the container through the inlet tube 50 must make a 180 degree change in direction in order to enter the off-gas hose 74. Since the powder has a greater mass and inertia than the gas, the powder has a greater tendency to continue to flow in the same direction while the gas changes its direction of flow. This effectively separates the powder from the gas, leaving the powder to settle on the bottom of the container. This also minimizes the entrainment of residual powder in the off-gas, which must be extracted by filtering equipment, to insure that the gas ultimately discharged into the atmosphere meets the very strict standards applied to nuclear manufacturing establishments. The size of the off-gas hose is sufficiently small so as to restrict the gas flow from the container thereby raising the container pressure so as to lower the powder discharge rate. Also, the adjustable valve 76 on the off-gas hose can be adjusted to vary the gas pressure in the container and in the conduit assembly 40. Thus, the adjustable valve on the off-gas hose provides a further control on powder discharge rates.

A roller conveyor 82 (shown in FIG. 1) is positioned beneath the fluidizing bed for transferring containers into a position for loading and out from under the fluidizing bed after loading has been completed.

The load cell 81 is mounted beneath the conveyor for the purpose of measuring the weignt of the container and the powder therein. The conveyor is constructed in sections, and the load cell is connected to a conveyor section 84 so as to directly measure the deflection of that section due to the weight of the container 70 and the powder therein.

Figure 6:
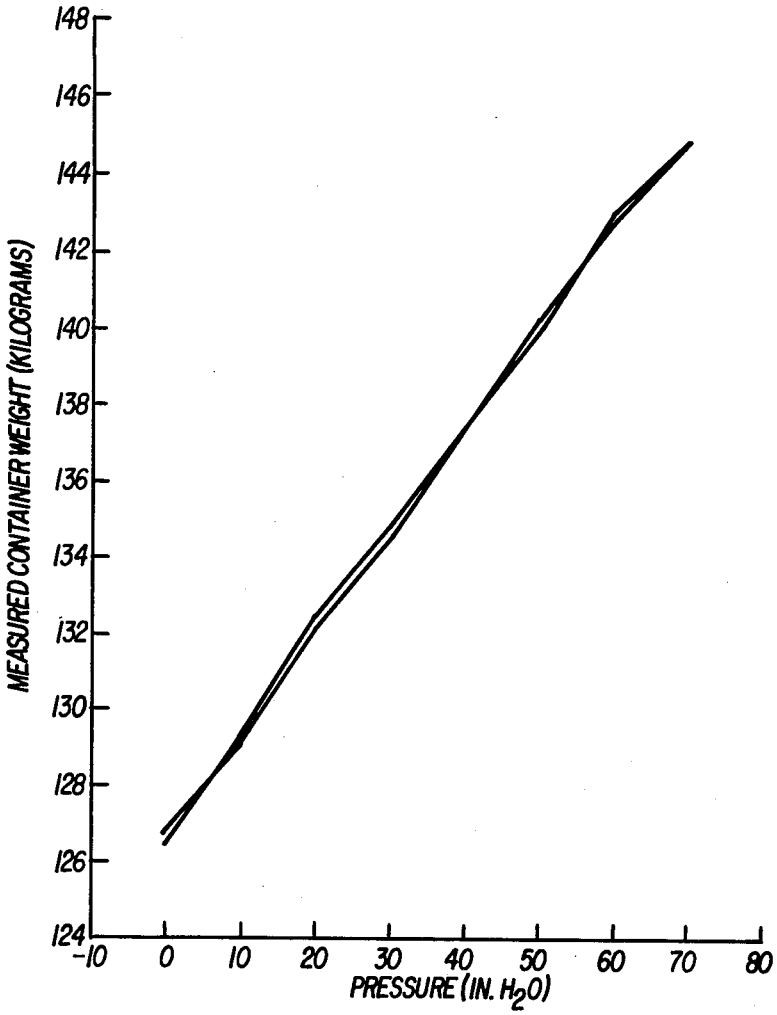
FIG. 6 is a graph showing the effect of fluidizing gas pressure on the container weight measuring system employed in the apparatus of this invention.

The container weight measuring system 80 (shown as a block diagram in FIG. 5) is provided with apparatus for the purpose of compensating for pressure forces exerted on the container by the fluidizing gas. Fluidizing gas pressure exerts a resultant, net downward force on the container because of the difference in surface areas between the top and bottom of the container. A circular cross-section is removed from the middle of the container lid to serve as the inlet 52 for the powder. The remaining section of the lid, therefore, has a lesser surface area than the bottom of the container. The fluidizing gas pressure, which acts equally in all directions, exerts a greater force on the container bottom than on the container lid. This creates a resultant, net downward force on the container. A graph which plots the effect of fluidizing gas pressure on the measured container weight is shown in FIG. 6. The ordinate of the graph corresponds to the load cell measurement of container weight, and the abscissa corresponds to the gas pressure inside the container. The plotted values clearly illustrate that increasing the gas pressure inside the container increases the load cell measurement of container weight.

To correct for this net, downward force, a pressure transducer 86 and a subtractor 88, both shown in FIG. 5, are provided to modify the electrical signal produced by the load cell 81. The pressure transducer 86 can be located in any position which permits the container pressure to be measured. In the particular embodiment of the invention the pressure transducer is connected with an instrument line 79 to the off-gas hose 74 directly adjacent the container. A purge rotometer 77 causes a small flow of gas to prevent any blocking of the instrument line 79 by any influx of entrained powder from the off-gas hose 74 which might otherwise block the instrument line 79. The rotometer employed in the current embodiment of this invention is a commercially available model #22-E 113SSXX made by Wallace and Tiernam. The transducer produces an electrical signal proportional to the gas pressure in the container, and this signal is transmitted to the subtractor 88. In the subtractor the pressure transducer signal is multiplied by an experimentally determined constant and the resultant signal is subtracted from the load cell electrical signal to produce an electrical output signal representative of the actual weight of the container and the powder therein.

Also shown in FIG. 5, is the apparatus for controlling the opening and closing of the valve 8 to fill the container with a predetermined weight of powder. The objective of this apparatus is to produce filled containers containing an amount of powder as close as possible to the predetermined amount. The apparatus includes a controller 90 for producing valve opening and closing signals at timed intervals. The opening signal, for example, is transmitted to a solenoid-operated air valve 92. The signal actuates the air valve to supply air through a line 94 to a pneumatic actuator 96. When the air valve is opened, and the air pressure is received, the pneumatic actuator rotates the ball 20 to its open position to provide discharge of powder from the fluidizing bed to the container for a predetermined period. The length of this period is programmed into the controller.

The controller in this embodiment may be of any suitable type. In a specific embodiment of the invention, the controller is a General Electric Logitrol Model No. CR455 that is commercially available and well know to those skilled in the art, with the comparator and pressure correction electronics being commercially available analog modules. The preferred controller is a microprocessor which would be capable of being programmed to accomplish container weight control with increased accuracy. One microprocessor suitable for this purpose is INTEL microprocessor, Model 80/10-4 sold by INTEL Corp. A microprocessor is preferable to a logitrol because a microprocessor can directly monitor the load cell and pressure transducer outputs, and can perform the weight correction and comparator function using high speed floating point hardware.

Since most of the force causing the powders to flow from the vessel 1 to the container 70 is due to the gravitational pressure head of the fluidized material in the vessel, the flow is greatest per unit of time when the vessel is full and decreases as the amount of powder in the vessel decreases. In order to compensate for this condition and provide for discharge of a substantially constant amount of powder during each discharge period, the controller is programmed to open the valve for timed discharge periods that increase in length of time as the amount of powder remaining in the fluidized bed diminishes. This length of time varies from approximately $\frac{3}{4}$ of a second when the fluidizing bed is completely filled with powder to approximately 2 seconds when the fluidizing bed is approaching empty. During each discharge period, approximately 3 kilograms or less of powder flow through the valve. Since the desired container weight is 31.5 kilograms, approximately 10 discharge periods are required to fill each container.

The comparator 89 is provided for signalling the controller when the comparator receives an electrical signal from the subtractor 88 indicating that the container has been filled with the desired amount of powder. The comparator receives the output signal directly from subtractor and compares the electrical strength of the signal received with a reference signal representative of the predetermined desired weight of powder. The reference signal is provided by the set point apparatus 85. When the subtractor signal received by the comparator equals the reference signal, the comparator signals the controller. The controller is programmed to close the valve 8 after it receives this signal from the comparator. At this point the container has been filled, and the controller is programmed to keep the valve closed until the filled container has been replaced with an empty container.

METHOD OF OPERATION

Operation of the apparatus begins when the fluidizing bed 1 is filled through the valved fill chute 2 with the various types of powders to be mixed. The valve on the fill chute is closed, and the mixing process is initiated by injecting fluidizing gas into the fluidizing bed from both the nozzle 28 and the orifices 24 in the ball valve. Injection of gas is continued until the powders are mixed to a homogeneous state. In the specific embodiment of this invention, 500 kilograms of powder are initially introduced into the fluidizing bed and complete mixing requires approximately 5 minutes of gas injection. During this period an empty container is transferred into a loading position beneath the fluidizing bed.

After the blending has been completed and a homogeneous mixture is achieved, the discharge sequence is initiated by the controller 90 which produces a signal to open the valve. When the valve is opened, powder and fluidizing gas initially flow at a rapid rate through the valve due to the pressure differential across the valve. As fluidizing gas continues to flow through the valve, it is retained in the conduit assembly 40 and the container 70, because of the closed substantially pressure-tight system formed by the vessel 1, the conduit assembly 40, and the container 70. As the gas accumulates in the conduit assembly and the container, the pressure differential across the valve diminishes. This equalizing of pressure occurs quite rapidly as the total volume of the conduit assembly and the container is substantially less than the total volume of the fluidizing bed. As the pressure differential diminishes, the flow rate decreases accordingly.

When the flow rate drops, the apparatus can more accurately fill the container with the desired amount of powder. The reason for this improvement in accuracy stems from the fact that the ball valve used to discharge powder has a minimum response time to actuate. This response time places a lower limit on the shortest possible discharge period, namely, the time required to open and immediately close the ball valve. The ultimate accuracy of the discharge system is dependent on the amount of powder which flows through the ball valve during this shortest possible discharge period. Since the quantity of material flowing through the valve for a fixed discharge period is directly proportional to the powder flow rate, reducing the flow rate will improve the accuracy of the discharge and metering apparatus. In addition, the previously described techniques of adjusting the valve 76 on the off-gas hose or of injecting fluidizing gas into the ball valve at a right angle to powder outflow could also be employed to variably control the flow rate as a container fills.

The controller is programmed to keep the valve open for a powder discharge period varying from three quarters of a second to 2 seconds so as to discharge approximately 3 kilograms of powder in each discharge period. After each discharge period the controller closes the valve.

Figure 7:
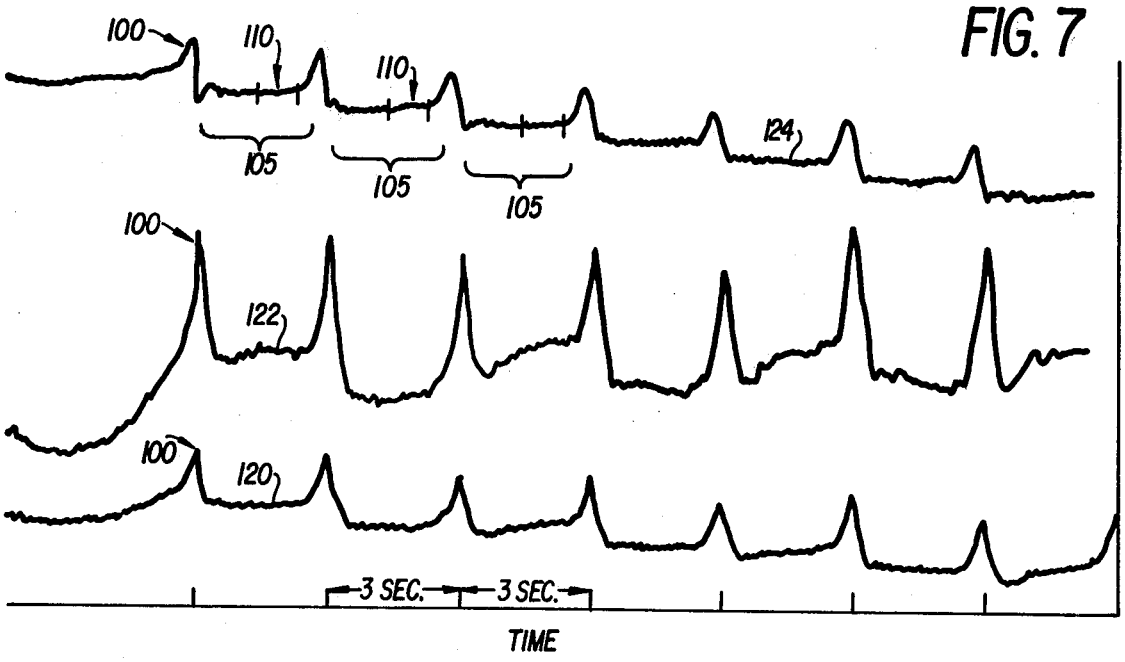
FIG. 7 is a graph showing the output of the container weight measuring system.

After closing the valve, the controller is programmed to wait a specific time period before re-opening the valve. During this down period the weight of the container is measured by the load cell 81, and a signal representative of the weight of the container is transmitted to the comparator 89. As stated earlier, when the comparator receives a signal equal to the reference signal, the comparator signals the controller that the container has reached the desired weight. However, rapid fluctuations of gas pressure in the apparatus are caused by the opening and closing of the valve. This causes a problem because these fluctuations create net downward forces on the container which affect the container weight measurement causing the comparator to inaccurately signal the controller that the container is loaded with the desired amount of powder. The effect of the pressure fluctuations on container weight measurement is graphically illustrated in FIG. 7. The abscissa in FIG. 7 is a time coordinate, and the ordinate corresponds to electrical signal strength. The lower output line 120 in the graph is the electrical signal produced by the load cell apparatus 81, the middle output line 122 is the signal produced by the pressure transducer 86, and the upper output line 124 is the corrected weight signal produced by the subtractor 88 which is transmitted to the comparator 89. The large upwardly extending projections 100 in the output lines represent those periods during which the valve is opened and closed. In the relatively quiescent periods 105 between projections, the ball valve is closed. In order to avoid the effect of fluctuations on container weight measurement performance, the controller monitors the comparator signal only during a window period indicated by the superimposed lines 110 on the graph.

In order to further eliminate any effect of these fluctuations on the accuracy of the operation of the weight measuring system, the controller is further programmed to delay the window period 110 a short time after the valve has closed so that this window period occurs during a relatively quiescent period.

While this above-stated process minimizes the effect of the major fluctuations on the container weight measurement apparatus, it can readily be seen that even during the window periods 110, electrical signals fluctuate, albeit less than when the ball valve is opened. When the container weight approaches a point when it has been loaded with the desired amount of powder, the smaller fluctuations in the corrected weight signal from the subtractor 88 equal the reference signal and begin to cause the comparator 89 to intermittently produce a signal to the controller. The apparatus also compensates for these smaller fluctuations, and this is accomplished by the controller programming. The controller is programmed to determine during what percent of the window period it is receiving a signal from the comparator. When this percent of the window period attains a certain experimentally determined value, the controller is programmed to close the valve and terminate the discharge sequence. If the comparator does not signal the controller for a sufficient percent of the window period 110, then the controller continues the discharge sequence and opens and closes the ball valve as previously described.

When the controller discontinues the discharge sequence, the fluidizing gas injection is discontinued and the fluidizing gas remaining in the bed is rapidly removed so as to "freeze" the particles in place and maintain a homogeneous mixture. The gas in the container is exhausted through the off-gas hose until the container pressure reaches atmospheric pressure. The lid is raised by pneumatic cylinders 78 and the container is transferred away from the fluidizing bed on the conveyor 82 and replaced with an empty container. Before the sequence of alternately opening and closing the valve is resumed to fill the new container, the fluidizing gas is re-injected into the fluidizing bed.

After the fluidizing gas is re-injected, the discharge sequence is repeated for the new container. The procedure is identical to that procedure previously described, with the exception that the duration of the discharge periods, when the ball valve is open, are increased in accordance with the programming of the controller. With this method, approximately the same amount of powder is discharged to the ball valve in each discharge period, thus improving the accuracy of the metering procedure. With this method, approximately 10 discharge periods are required to fill each container from that point when the fluidizing bed is completely filled with powder to that point when the fluidizing bed is virtually empty. Finally, when the powder in the fluidizing bed is completely discharged, the injection of fluidizing gas is terminated, the fluidizing gas is exhausted from the bed and the various types of powders are again introduced to the fill chute 2. The entire procedure as hereinbefore described is repeated.

We claim:

1. An apparatus to discharge and meter powder from a fluidizing vessel into a container positioned below the vessel comprising:

(a) a valve mounted below said vessel to control the discharge of powder from said vessel;

(b) a conduit assembly disposed between said valve and said container;

(c) said vessel, valve, conduit assembly and container forming a substantially pressure-tight system for minimizing pressure differential across said valve caused by fluidizing gas;

(d) means to alternately open and close said valve to cause short duration discharges of powder;

(e) means to measure the weight of powder discharged into said container; and (f) means to discontinue opening of said valve when a predetermined weight of powder has been discharged into said container.

2. The apparatus as recited in claim 1, wherein said means for measuring the weight of powder discharged into said container comprises a load cell upon which said container is supported, said load cell developing a first signal representative of the weight of said container and the powder therein.

3. The apparatus as recited in claim 2, wherein said means for discontinuing opening of said valve includes:

(a) a comparator having a first input terminal for receiving said first signal;

(b) means for developing a reference signal representative of a predetermined desired weight of said container and the powder therein;

(c) said comparator having a second input terminal for receiving said reference signal; and (d) said comparator transmitting an output signal for discontinuing opening of said valve when said first signal equals said reference signal.

4. The apparatus recited in claim 2, and further including means for compensating for the effects of fluidizing gas pressure on the container, said compensating means comprising:

(a) a pressure transducer responsive to the pressure in said container to produce a second signal representative of the gas pressure on said container; and (b) a subtractor receiving said first signal and said second signal and, producing at its output, a third signal representative of the actual weight of the container and the powder discharged therein.

5. The apparatus recited in claim 1, wherein said conduit assembly comprises:

(a) an inlet extending upwardly from said container;

(b) an outlet tube extending downwardly from said valve and being received in said upwardly extending inlet; and (c) a sleeve surrounding said outlet tube and said inlet, said sleeve being clamped to said outlet tube and said inlet at its upper and lower ends, respectively, to provide a substantially pressure-tight connection, said sleeve being constructed of a flexible, reinforced material to prevent said sleeve from distorting with angular misalignment and affecting weight measurements.

6. The apparatus recited in claim 1, and further including:

(a) a lid on said container; and (b) an off-gas hose extending upwardly from said lid, said off-gas hose oriented in relation to said conduit to force the gas discharged from said conduit assembly to reverse direction and flow upwardly in order to enter said off-gas hose, thereby utilizing inertial forces to cause separation of powder from said gas, and said off-gas hose being sufficiently small in size so as to restrict the gas flow from the container, thereby raising the container pressure.

7. The apparatus recited in claim 6, and further including an adjustable valve in said off-gas hose to further raise the container pressure and further restrict the off-gas flow.

8. The apparatus recited in claim 1, wherein said valve includes:

(a) a valve body;

(b) a ball-shaped closure member rotatably mounted in said valve body;

(c) a large aperture through said closure member arranged to provide, in the open position of said valve, a flow path for powder from said vessel to said container;

(d) a plurality of small apertures providing communication between said large aperture and the surface of said ball-shaped closure member;

(e) means for supplying fluidizing gas to said valve body;

(f) said small apertures, in the closed position of said valve, receiving fluidizing gas from said large aperture and directing said gas upwardly into said vessel; and (g) said small apertures, in the open position of said valve, receiving fluidizing gas and directing said gas into said large aperture at a right angle to the flow of powder therethrough for restricting said flow path to reduce the rate of powder discharge through said large aperture.

9. A method of discharging and metering powder from a fluidizing vessel into a material-receiving container comprising the steps of:

(a) alternately opening and closing a valve mounted below said fluidizing vessel to cause discharge of powder and gas from said vessel in short duration discharge periods;

(b) increasing the duration of said discharges in inverse proportion to the amount of powder remaining in said fluidizing vessel whereby substantially equal amounts of powder are discharged in each discharge period;

(c) weighing the container and powder therein; and
(d) terminating the discharge of powder from the fluidizing vessel when the weight of the container and powder therein reaches a predetermined amount.

10. The method recited in claim 9, and further including the steps of:
(a) weighing the container and powder therein only during the periods between discharges when said valve is closed; and
(b) delaying said weighing a predetermined time period after said valve is closed to eliminate the effect on the indicated weight of the container and powder therein, caused by pressure fluctuations resulting from opening and closing said valve.

11. The method recited in claim 9, and further including the step of injecting fluidizing gas into said valve at a right angle to powder flow, said fluidizing gas restricting the flow path of powder from the fluidizing vessel through said valve to reduce the rate of flow of powder.

12. A method of discharging and metering powder from a fluidizing vessel into a material-receiving container comprising the steps of:
(a) alternately opening and closing a valve mounted below said fluidizing vessel to cause discharge of powder and gas from said vessel in short duration discharge periods;
(b) retaining substantially all of the discharged gas in the container to cause the pressure in the fluidizing vessel and the container to equalize, thereby decreasing the rate of discharge of powder and gas through said valve;
(c) weighing the container and the powder therein; and
(d) terminating the discharge of powder from said fluidizing vessel when the weight of the container and powder therein reaches a predetermined amount.

13. The method as recited in claim 12, and further including the steps of:
(a) suddenly removing the fluidizing gas from the fluidizing vessel after a container has been filled with a predetermined weight of powder; and
(b) suddenly re-injecting the fluidizing gas before the initiation of the sequence of alternately opening and closing the valve to fill another container.

* * * * *